US010377564B2

(12) United States Patent
Campbell

(10) Patent No.: US 10,377,564 B2
(45) Date of Patent: Aug. 13, 2019

(54) DEODORIZING WASTE RECEPTACLE

(71) Applicant: Alice Campbell, Cranford, NJ (US)

(72) Inventor: Alice Campbell, Cranford, NJ (US)

( * ) Notice: Subject to any disclaimer, the term of this patent is extended or adjusted under 35 U.S.C. 154(b) by 399 days.

(21) Appl. No.: 15/248,233

(22) Filed: Aug. 26, 2016

(65) Prior Publication Data

US 2018/0057257 A1 Mar. 1, 2018

(51) Int. Cl.

| | |
|---|---|
| ***B65F 1/10*** | (2006.01) |
| ***B65F 1/12*** | (2006.01) |
| ***B65F 1/16*** | (2006.01) |
| ***B65F 1/06*** | (2006.01) |
| ***B65F 1/14*** | (2006.01) |

(52) U.S. Cl.

CPC ..... *B65F 1/10* (2013.01); *B65F 1/068* (2013.01); *B65F 1/12* (2013.01); *B65F 1/1405* (2013.01); *B65F 1/163* (2013.01); *B65F 2001/1676* (2013.01); *B65F 2210/1026* (2013.01); *B65F 2210/129* (2013.01); *B65F 2230/134* (2013.01); *B65F 2240/132* (2013.01); *B65F 2250/11* (2013.01); *B65F 2250/112* (2013.01)

(58) Field of Classification Search

CPC .. B65F 1/163; B65F 1/10; B65F 1/068; B65F 1/12; B65F 1/1405; B65F 2001/1676; B65F 2210/1026; B65F 2210/129; B65F 2230/134; B65F 2240/132; B65F 2250/11; B65F 2250/112; B65D 43/26; Y10S 220/908; Y10S 220/9082; Y10S 220/9081; Y10S 220/909

USPC ..... 220/262, 263, 908, 908.2, 501, 908.1, 220/908.3, 909, 910, 911

See application file for complete search history.

(56) References Cited

U.S. PATENT DOCUMENTS

| | | | | |
|---|---|---|---|---|
| 1,479,634 | A * | 1/1924 | Toscan | B65F 1/163 220/263 |
| 1,699,220 | A * | 1/1929 | Boykin | F26B 5/04 220/23.87 |
| 5,242,220 | A * | 9/1993 | Sandreth | B65F 1/006 220/495.08 |
| 5,385,259 | A | 1/1995 | Bernstein et al. | |
| 5,487,502 | A * | 1/1996 | Liao | A41G 1/006 222/648 |
| 5,655,680 | A | 8/1997 | Asbach et al. | |
| D431,888 | S | 10/2000 | Roudebush | |
| 7,225,943 | B2 * | 6/2007 | Yang | A61L 9/014 220/23.9 |

(Continued)

*Primary Examiner* — Anthony D Stashick
*Assistant Examiner* — Onekki P Jolly

(57) ABSTRACT

A deodorizing waste receptacle for disposal of soiled adult diapers includes a housing. The housing comprises an annular wall that is coupled to and extends upwardly from a bottom to define both a top and an internal space. A funnel is coupled to the housing and positioned in the internal space. A drawer is insertable into a lower chamber of the housing through an opening in the housing. A lid is reversibly and sealably couplable to the top to cover an aperture. An actuator is coupled to the housing positioned to motivate the lid between a closed to an open configuration. A plunger, which is coupled to the lid, is configured to compressibly motivate a soiled diaper through the funnel into the drawer. Deodorizers and dispensers are positioned in the housing to absorb and mask, respectively, odiferous gasses generated by soiled diapers positioned in the internal space.

16 Claims, 5 Drawing Sheets

(56) References Cited

U.S. PATENT DOCUMENTS

| | | | | |
|---|---|---|---|---|
| 7,708,188 | B2 * | 5/2010 | Stravitz | B65B 67/1277 220/908.1 |
| 7,878,359 | B1 | 2/2011 | Ko | |
| 7,958,994 | B2 * | 6/2011 | Weinmann | A61F 15/003 206/233 |
| 8,245,864 | B2 | 8/2012 | Garland | |
| 8,910,821 | B1 | 12/2014 | Stravitz | |
| 2003/0136279 | A1 | 7/2003 | Tarlow | |
| 2004/0251317 | A1 * | 12/2004 | Blanck | A01M 1/2038 239/350 |
| 2005/0121015 | A1 * | 6/2005 | Postorivo, Jr. | F41B 11/52 124/49 |
| 2006/0081632 | A1 | 4/2006 | Shieh | |
| 2007/0125792 | A1 | 6/2007 | Pollack et al. | |
| 2009/0120820 | A1 * | 5/2009 | Iske | A61M 5/3205 206/366 |
| 2009/0184125 | A1 * | 7/2009 | Brown | B65F 1/0006 220/502 |
| 2010/0224627 | A1 | 9/2010 | Yang et al. | |
| 2011/0030557 | A1 * | 2/2011 | Brownstein | B01D 39/1623 95/273 |
| 2011/0127269 | A1 * | 6/2011 | Bucholtz | B65D 43/162 220/378 |
| 2013/0256314 | A1 * | 10/2013 | Marconi | B65F 1/067 220/495.09 |
| 2014/0246432 | A1 * | 9/2014 | Yang | B65D 43/262 220/262 |
| 2015/0368003 | A1 * | 12/2015 | Freedman | B65D 41/005 220/315 |
| 2017/0313509 | A1 * | 11/2017 | Mshamma | B65F 1/062 |

* cited by examiner

DEODORIZING WASTE RECEPTACLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to waste receptacles and more particularly pertains to a new waste receptacle for disposal of soiled adult diapers.

BRIEF SUMMARY OF THE INVENTION

An embodiment of the disclosure meets the needs presented above by generally comprising a housing. The housing comprises an annular wall that is coupled to and extends upwardly from a bottom to define both a top and an internal space. A funnel is coupled to the housing and positioned in the internal space. A drawer is insertable into a lower chamber of the housing through an opening in the housing. A lid is reversibly and sealably couplable to the top to cover an aperture. An actuator is coupled to the housing positioned to motivate the lid between a closed to an open configuration. A plunger, which is coupled to the lid, is configured to compressibly motivate a soiled diaper through the funnel into the drawer. Deodorizers and dispensers are positioned in the housing to absorb and mask, respectively, odiferous gasses generated by soiled diapers positioned in the internal space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
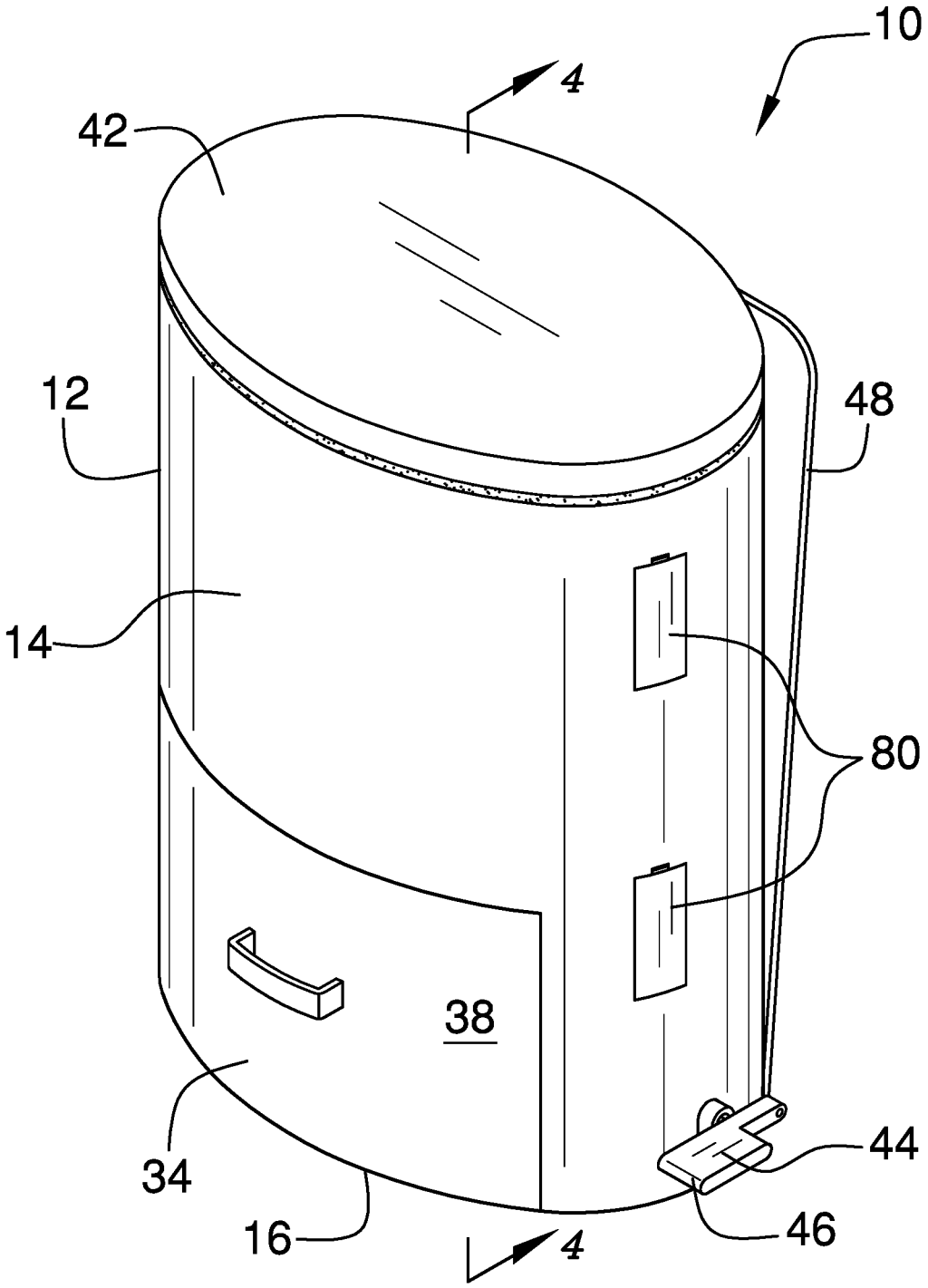
FIG. 1 is an isometric perspective view of a deodorizing waste receptacle according to an embodiment of the disclosure.
Figure 2:
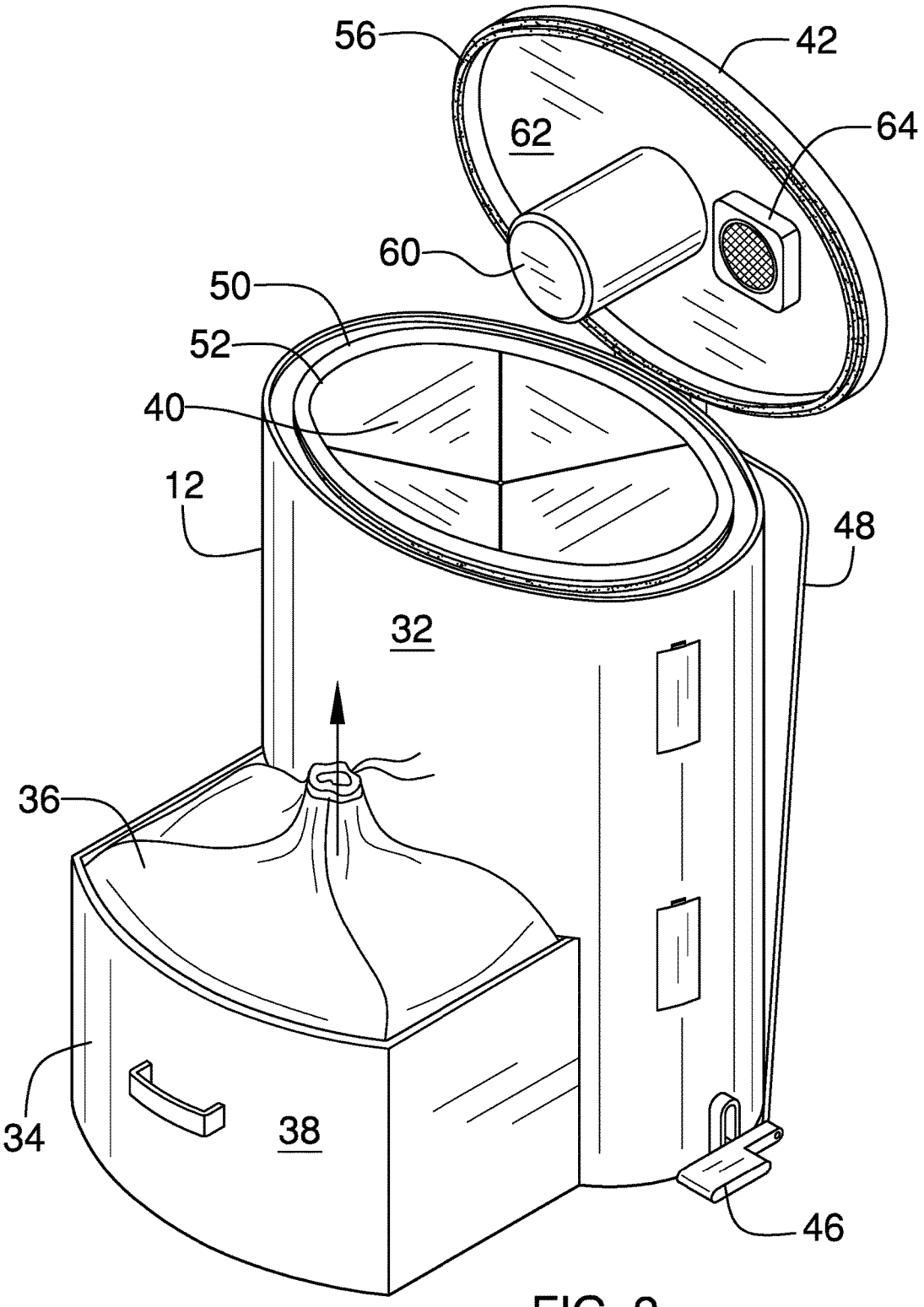
FIG. 2 is an isometric perspective view of an embodiment of the disclosure.
Figure 3:
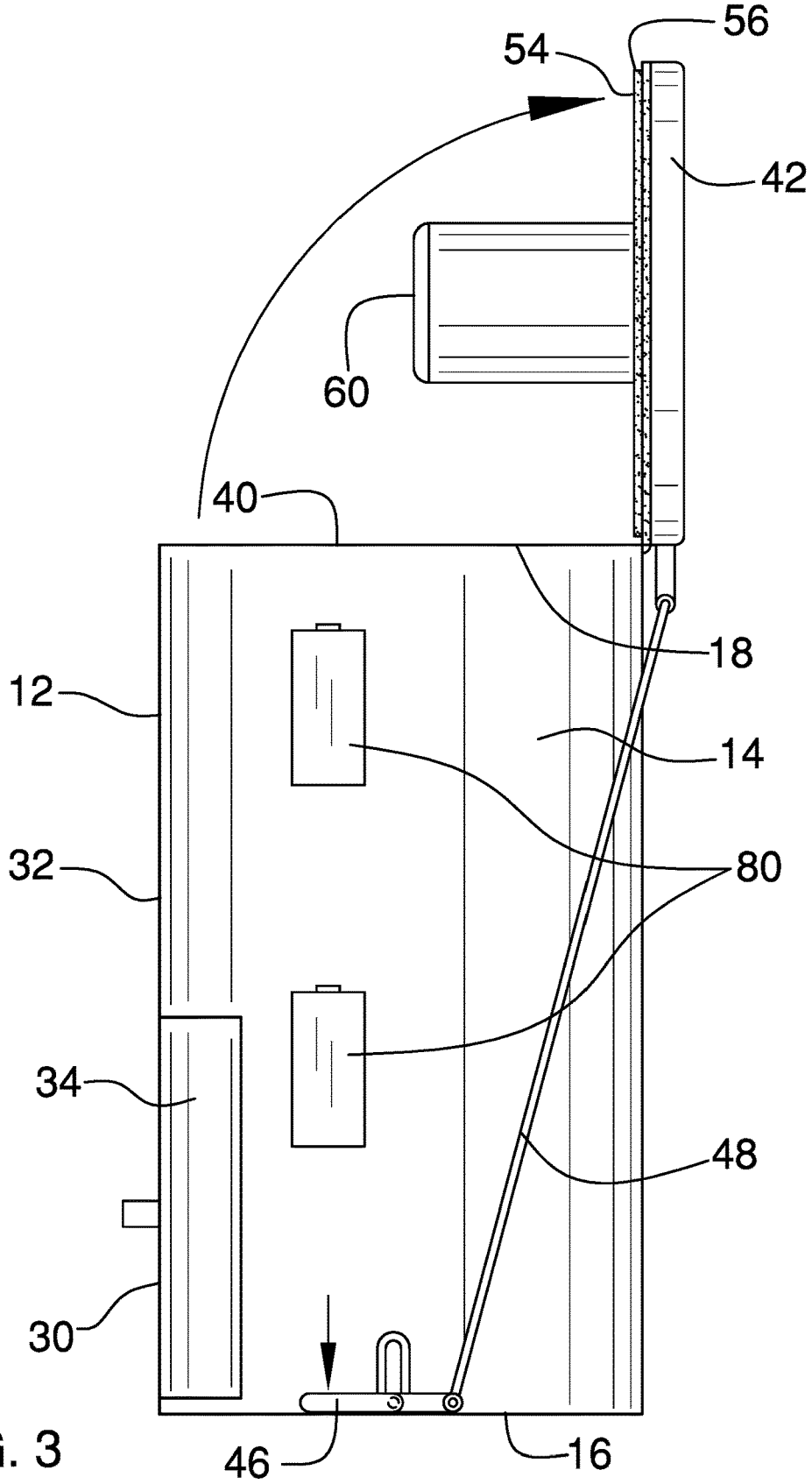
FIG. 3 is a side view of an embodiment of the disclosure.
Figure 4:
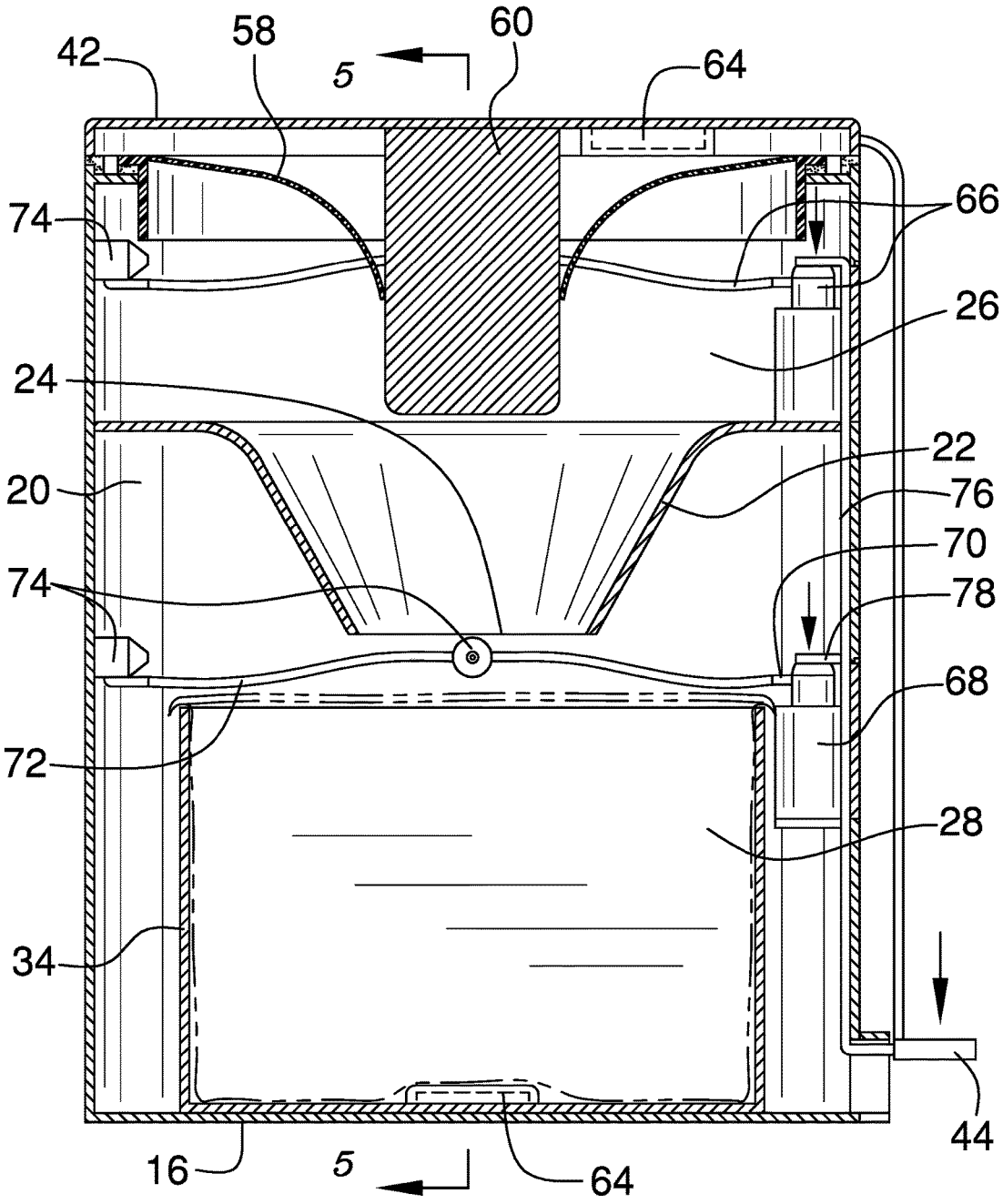
FIG. 4 is a cross-sectional view of an embodiment of the disclosure.
Figure 5:
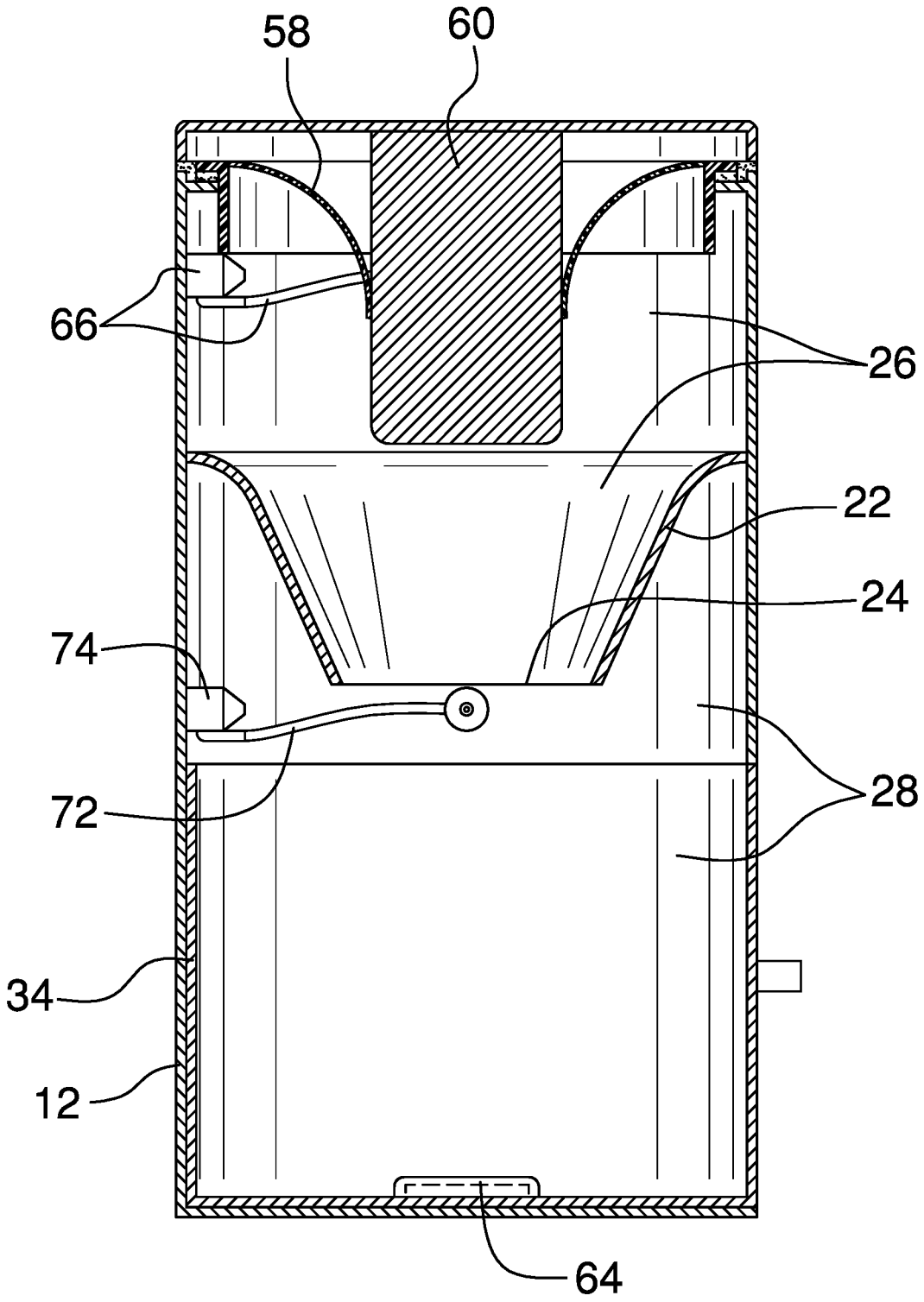
FIG. 5 is a cross-sectional view of an embodiment of the disclosure.

With reference now to the drawings, and in particular to FIGS. 1 through 5 thereof, a new waste receptacle embodying the principles and concepts of an embodiment of the disclosure and generally designated by the reference numeral 10 will be described.

As best illustrated in FIGS. 1 through 5, the deodorizing waste receptacle 10 generally comprises a housing 12. The housing 12 comprises an annular wall 14 that is coupled to and extends upwardly from a bottom 16 to define a top 18. The housing 12 defines an internal space 20. In one embodiment, the top 18 and the bottom 16 are substantially dimensionally equivalent, such that the annular wall 14 is substantially perpendicular to the bottom 16. In another embodiment, the top 18 and the bottom 16 are ovally shaped. In yet another embodiment, the housing 12 comprises metal. In still yet another embodiment, the housing 12 comprises stainless steel.

A funnel 22 is coupled to the housing 12 and positioned in the internal space 20. A lower end 24 of the funnel 22 is positioned substantially equally distant from the bottom 16 and the top 18. The funnel 22 and the top 18 define an upper chamber 26 of the housing 12. The funnel 22 and the bottom 16 define a lower chamber 28 of the housing 12.

An opening 30 is positioned in a front 32 of the housing 12. A drawer 34 is insertable through the opening 30 into the lower chamber 28. The drawer 34 is configured to position a liner 36. The drawer 34 has an exposed face 38 that is complementary to the opening 30. The drawer 34 is sealably couplable to the housing 12, such that the opening 30 is substantially closed when the drawer 34 is positioned in the lower chamber 28. In one embodiment, the drawer 34 comprises metal. In another embodiment, the drawer 34 comprises stainless steel.

An aperture 40 is positioned in the top 18. A lid 42 is hingedly coupled to the housing 12 proximate to the top 18. The lid 42 is complementary to the aperture 40. The lid 42 is reversibly and sealably couplable to the top 18 to cover the aperture 40. In one embodiment, the lid 42 comprises metal. In another embodiment, the lid 42 comprises stainless steel.

An actuator 44 is coupled to the housing 12. The actuator 44 is operationally coupled to the lid 42. The actuator 44 is positioned to motivate the lid 42 from a closed configuration to an open configuration. In one embodiment, the actuator 44 comprises a pedal 46 and a first bar 48. The pedal 46 is pivotally coupled to the housing 12 proximate to the bottom 16. The first bar 48 is coupled to and extends between the pedal 46 and the lid 42. The pedal 46 is positioned on the housing 12 such that the pedal 46 is configured to be depressed by a foot of the user. Depressing the pedal 46 motivates the lid 42 from the closed configuration to the open configuration.

In one embodiment, a first seal 50 is coupled to the top 18 adjacent to a circumference 52 of the aperture 40. A second seal 54 is coupled to the lid 42 adjacent to a perimeter 56 of the lid 42. The second seal 54 is positioned on the lid 42 such that the second seal 54 is positioned to sealably couple to the first seal 50 to prevent escape of odiferous gasses from the internal space 20.

A plurality of flaps 58 is coupled to the housing 12 and positioned in the internal space 20 proximate to the top 18. The flaps 58 are resilient. The flaps 58 are configured to substantially close the aperture 40 when the lid 42 is positioned in the open configuration.

A plunger 60 is coupled to an inside surface 62 of the lid 42. The plunger 60 is positioned on the lid 42 such that the plunger 60 is configured to contact a soiled diaper positioned in the upper chamber 26. The diaper is compressibly motivated through the funnel 22 into the drawer 34. In one embodiment, the plunger 60 is substantially cylindrically shaped.

A plurality of deodorizers 64 is coupled to the housing 12 and positioned in the internal space 20. The deodorizers 64 are positioned in the housing 12 such that the deodorizers 64 are configured to absorb odiferous gasses generated by soiled diapers positioned in the internal space 20. In one embodiment, the deodorizers 64 comprise carbon. In another embodiment, the plurality of deodorizers 64 comprises deodorizers 64 positioned singly on the lid 42 and the bottom 16.

A plurality of dispensers 66 is coupled to the housing 12 and positioned in the internal space 20. The dispensers 66 are configured to emit fragrance. The dispensers 66 are positioned in the housing 12 such that the dispensers 66 are configured to emit fragrance to mask odiferous gasses generated by soiled diapers positioned in the internal space 20. The dispensers 66 are operationally coupled to the actuator 44. The dispensers 66 emit fragrance as the lid 42 is motivated by the actuator 44 from the closed configuration to the open configuration. In one embodiment, the plurality of dispensers 66 comprises dispensers 66 positioned singly in the upper chamber 26 and the lower chamber 28.

In another embodiment, each dispenser 66 comprises an aerosol can 68 that is configured with a tip 70. A tube 72 is coupled to and extends from the tip 70 of the aerosol can 68. A plurality of nozzles 74 is coupled to the housing 12 and fluidically coupled to the tube 72. The tip 70 is positioned on the aerosol can 68 such that the tip 70 is configured to be depressed. Fragrance is emitted from the aerosol can 68 through the tip 70, the tube 72 and the nozzles 74 into the internal space 20.

In yet another embodiment, a second bar 76 is coupled to the pedal 46. The second bar 76 extends into the internal space 20, such that the second bar 76 is positioned proximate to each aerosol can 68. Each of a plurality of tabs 78 is coupled to and extends perpendicularly from the second bar 76. Each tab 78 is positioned on the second bar 76 such that the tab 78 is positioned to depress a respective tip 70 as the pedal 46 is depressed by the foot of the user.

Each of a plurality of access panels 80 is reversibly couplable to the housing 12 proximate to a respective dispenser. The access panels 80 are positioned on the housing 12 such that each access panels 80 is configured to be removed by the user to access a respective dispenser 66.

The present invention anticipates the receptacle 10 comprising a wrapping unit. The wrapping unit would be coupled to the housing 12 and positioned in the upper chamber 26 of the housing 12. The wrapping unit would apply a wrap to each soiled diaper as the soiled diaper is positioned in the upper chamber 26. The wrapping unit would sealably close the wrap around the soiled diaper.

The present invention also anticipates the receptacle 10 comprising a sealer that would be coupled to the housing 12 and positioned in the lower chamber 28. The sealer would seal the liner 36 when the liner 36 is filled, such that the liner 36 and soiled diapers are configured for sanitary removal from the lower chamber 28.

The present invention also anticipates the receptacle 10 comprising an indicator light. In one embodiment, the indicator light would be positioned on the housing 12. In another embodiment, the indicator light would be positioned on the lid 42. The indicator light would illuminate when the liner 36 and soiled diapers are configured for sanitary removal from the lower chamber 28.

In use, the actuator 44 is positioned to motivate the lid 42 from a closed configuration to an open configuration. The plunger 60 is positioned on the lid 42 and is configured to contact a soiled diaper that is positioned in the upper chamber 26 as the lid 42 is motivated by the actuator 44 from the open configuration to the closed configuration. The diaper is compressibly motivated by the plunger 60 through the funnel 22 into the drawer 34. The deodorizers 64 and the dispensers 66 are positioned in the housing 12 such that the deodorizers 64 are configured to absorb, and the dispensers 66 are configured to emit fragrance to mask, odiferous gasses generated by soiled diapers positioned in the internal space 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A deodorizing waste receptacle comprising:

a housing comprising an annular wall and a bottom, said annular wall being coupled to and extending upwardly from said bottom, an upper edge of said annular wall defining a top of said housing, said housing defining an internal space;

a funnel coupled to said housing and positioned in said internal space, such that a lower end of said funnel is positioned substantially equally distant from said bottom and said top, said funnel and said top defining an upper chamber of said housing, said funnel and said bottom defining a lower chamber of said housing;

an opening positioned in a front of said housing;

a drawer insertable through said opening into said lower chamber, said drawer being configured for positioning of a liner;

an aperture positioned in said top;

a lid hingedly coupled to said housing proximate to said top, said lid being complementary to said aperture, said lid being sealably couplable to said top to cover said aperture;

an actuator coupled to said housing, said actuator being operationally coupled to said lid;

a plunger coupled to an inside surface of said lid;

a plurality of deodorizers coupled to said housing and positioned in said internal space;

a plurality of dispensers coupled to said housing and positioned in said internal space, said dispensers being configured to emit fragrance, each said dispenser comprising an aerosol can, each said aerosol can being configured with a respective tip;

wherein said actuator is positioned to motivate said lid from a closed configuration to an open configuration, wherein said plunger is positioned on said lid such that said plunger is configured to contact a soiled diaper positioned in said upper chamber as said lid is motivated by said actuator from the open configuration to the closed configuration, such that the soiled diaper is compressibly motivated through said funnel into said drawer, wherein said deodorizers and said dispensers are positioned in said housing such that said deodorizers are configured to absorb, and said dispensers are configured to emit fragrance to mask, gasses generated by soiled diapers positioned in said internal space;

a first bar, said first bar being coupled to and extending between said pedal and said lid;

a second bar coupled to said pedal, said second bar extending into said internal space, such that said second bar is positioned proximate to each said aerosol can;

a plurality of tabs coupled to and extending perpendicularly from said second bar; and wherein each said tab is positioned on said second bar such that said tab is positioned to depress a respective said tip as said pedal is depressed by the foot of the user.

2. The receptacle of claim 1, further including said top and said bottom being substantially dimensionally equivalent, such that said annular wall is substantially perpendicular to said bottom.

3. The receptacle of claim 1, further including said top and said bottom being ovally shaped.

4. The receptacle of claim 1, further including said housing, said lid and said drawer comprising metal.

5. The receptacle of claim 1, further including said housing, said lid and said drawer comprising stainless steel.

6. The receptacle of claim 1, further including said drawer having an exposed face, said exposed face being complementary to said opening, said drawer being sealably couplable to said housing, such that said opening is substantially closed when said drawer is positioned in said lower chamber.

7. The receptacle of claim 1, further including said actuator comprising:

a pedal, said pedal being pivotally coupled to said housing proximate to said bottom;

and wherein said pedal is positioned on said housing such that said pedal is configured for depression by a foot of the user, such that said pedal motivates said lid from the closed configuration to the open configuration.

8. The receptacle of claim 1, further comprising:

a first seal coupled to said top adjacent to a circumference of said aperture;

a second seal coupled to said lid adjacent to a perimeter of said lid; and wherein said second seal is positioned on said lid such that said second seal is positioned to sealably couple to said first seal to prevent escape of gasses from said internal space.

9. The receptacle of claim 1, further including a plurality of flaps coupled to said housing and positioned in said internal space proximate to said top, said flaps being resilient, said flaps being configured to substantially close said aperture when said lid is positioned in the open configuration.

10. The receptacle of claim 1, further including said plunger being substantially cylindrically shaped.

11. The receptacle of claim 1, further including said deodorizers comprising carbon.

12. The receptacle of claim 1, further including said dispensers being operationally coupled to said actuator, such that said dispensers emit fragrance as said lid is motivated by said actuator from the closed configuration to the open configuration.

13. The receptacle of claim 1, further comprising:

said plurality of deodorizers comprising said deodorizers positioned singly on said lid and said bottom; and said plurality of dispensers comprising said dispensers positioned singly in said upper chamber and said lower chamber.

14. The receptacle of claim 1, further including each said dispenser comprising:

a tube coupled to and extending from said tip of said aerosol can;

a plurality of nozzles coupled to said housing, said nozzles being fluidically coupled to said tube; and wherein said tip is positioned on said aerosol can such that said tip is configured to be depressed, wherein fragrance is emitted from said aerosol can through said tip, through said tube, through said nozzles, and into said internal space.

15. The receptacle of claim 1, further including a plurality of access panels, each said access panel being reversibly couplable to said housing proximate to a respective said dispenser, wherein each said access panel is positioned on said housing such that said access panel is configured for removal by the user to access a respective said dispenser.

16. A deodorizing waste receptacle comprising:

a housing comprising an annular wall and a bottom, said annular wall being coupled to and extending upwardly from said bottom, an upper edge of said annular wall defining a top of said housing, said housing defining an internal space, said top and said bottom being substantially dimensionally equivalent, such that said annular wall is substantially perpendicular to said bottom, said top and said bottom being ovally shaped, said housing comprising metal, said housing comprising stainless steel;

a funnel coupled to said housing and positioned in said internal space, such that a lower end of said funnel is positioned substantially equally distant from said bottom and said top, said funnel and said top defining an upper chamber of said housing, said funnel and said bottom defining a lower chamber of said housing;

an opening positioned in a front of said housing;

a drawer insertable through said opening into said lower chamber, said drawer being configured for positioning of a liner, said drawer having an exposed face, said exposed face being complementary to said opening, said drawer being sealably couplable to said housing, such that said opening is substantially closed when said drawer is positioned in said lower chamber, said drawer comprising metal, said drawer comprising stainless steel;

an aperture positioned in said top;

a lid hingedly coupled to said housing proximate to said top, said lid being complementary to said aperture, said lid being sealably couplable to said top to cover said aperture, said lid comprising metal, said lid comprising stainless steel;

an actuator coupled to said housing, said actuator being operationally coupled to said lid, wherein said actuator is positioned to motivate said lid from a closed configuration to an open configuration, said actuator comprising a pedal and a first bar, said pedal being pivotally coupled to said housing proximate to said bottom, said first bar being coupled to and extending between said pedal and said lid, wherein said pedal is positioned on said housing such that said pedal is configured for depression by a foot of the user, wherein said pedal motivates said lid from the closed configuration to the open configuration;

a first seal coupled to said top adjacent to a circumference of said aperture;

a second seal coupled to said lid adjacent to a perimeter of said lid, wherein said second seal is positioned on said lid such that said second seal is positioned to sealably couple to said first seal to prevent escape of odiferous gasses from said internal space;

a plurality of flaps coupled to said housing and positioned in said internal space proximate to said top, said flaps being resilient, said flaps being configured to substantially close said aperture when said lid is positioned in the open configuration;

a plunger coupled to an inside surface of said lid, wherein said plunger is positioned on said lid such that said plunger is configured to contact a soiled diaper positioned in said upper chamber as said lid is motivated by said actuator from the open configuration to the closed configuration, such that the soiled diaper is compressibly motivated through said funnel into said drawer, said plunger being substantially cylindrically shaped;

a plurality of deodorizers coupled to said housing and positioned in said internal space, wherein said deodorizers are positioned in said housing such that said deodorizers are configured to absorb odiferous gasses generated by soiled diapers positioned in said internal space, said deodorizers comprising carbon, said plurality of deodorizers comprising said deodorizers positioned singly on said lid and said bottom;

a plurality of dispensers coupled to said housing and positioned in said internal space, said dispensers being configured to emit fragrance, wherein said dispensers are positioned in said housing such that said dispensers are configured to emit fragrance to mask gasses generated by soiled diapers positioned in said internal space, said dispensers being operationally coupled to said actuator, such that said dispensers emit fragrance as said lid is motivated by said actuator from the closed configuration to the open configuration, said plurality of dispensers comprising said dispensers positioned singly in said upper chamber and said lower chamber, each said dispenser comprising:

an aerosol can, said aerosol can being configured with a tip, a tube coupled to and extending from said tip of said aerosol can, a plurality of nozzles coupled to said housing, said nozzles being fluidically coupled to said tube, and wherein said tip is positioned on said aerosol can such that said tip is configured to be depressed, wherein fragrance is emitted from said aerosol can through said tip, through said tube, through said nozzles, and into said internal space;

a second bar coupled to said pedal, said second bar extending into said internal space, such that said second bar is positioned proximate to each said aerosol can;

a plurality of tabs coupled to and extending perpendicularly from said second bar, wherein each said tab is positioned on said second bar such that said tab is positioned to depress a respective said tip as said pedal is depressed by the foot of the user;

a plurality of access panels, each said access panel being reversibly couplable to said housing proximate to a respective said dispenser, wherein each said access panel is positioned on said housing such that said access panel is configured for removal by the user to access a respective said dispenser; and wherein said actuator is positioned to motivate said lid from a closed configuration to an open configuration, wherein said plunger is positioned on said lid such that said plunger is configured to contact a soiled diaper positioned in said upper chamber as said lid is motivated by said actuator from the open configuration to the closed configuration, such that the soiled diaper is compressibly motivated through said funnel into said drawer, wherein said deodorizers and said dispensers are positioned in said housing such that said deodorizers are configured to absorb, and said dispensers are configured to emit fragrance to mask, gasses generated by soiled diapers positioned in said internal space.

* * * * *